United States Patent [19]

Kantor

[11] Patent Number: 5,041,076

[45] Date of Patent: Aug. 20, 1991

[54] ROTARY INERTIAL THERMODYNAMIC MULTI-STAGE MASS-FLOW DIVIDER

[76] Inventor: Frederick W. Kantor, 523 W. 112 St., New York, N.Y. 10025

[21] Appl. No.: 353,147

[22] Filed: May 12, 1989

Related U.S. Application Data

[60] Continuation-in-part of Ser. No. 151,472, Feb. 2, 1988, abandoned, which is a continuation-in-part of Ser. No. 910,820, Sep. 23, 1986, Pat. No. 4,722,194, which is a continuation of Ser. No. 748,731, Jun. 25, 1985, abandoned, which is a continuation-in-part of Ser. No. 598,366, Apr. 9, 1984, Pat. No. 4,524,587, which is a continuation-in-part of Ser. No. 456,709, Jan. 10, 1983, Pat. No. 4,441,337, which is a division of Ser. No. 240,135, Mar. 31, 1981, Pat. No. 4,367,639, which is a continuation of Ser. No. 4,606, Jan. 18, 1979, abandoned, which is a division of Ser. No. 770,316, Feb. 18, 1977, Pat. No. 4,136,530, which is a division of Ser. No. 569,478, Apr. 18, 1975, Pat. No. 4,010,018, which is a continuation of Ser. No. 78,552, Oct. 6, 1970, abandoned, which is a continuation-in-part of Ser. No. 864,112, Oct. 6, 1969, Pat. No. 3,808,828, which is a continuation-in-part of Ser. No. 608,323, Jan. 10, 1967, Pat. No. 3,470,704.

[51] Int. Cl.[5] ..... B01D 21/26; B04B 5/02; B04B 15/02

[52] U.S. Cl. ..... 494/37; 494/13; 494/32; 494/42; 494/900

[58] Field of Search ..... 494/43, 37, 35, 31, 494/32, 33, 34, 41, 85, 900, 13; 422/72

[56] References Cited

U.S. PATENT DOCUMENTS

| | | | |
|---|---|---|---|
| 2,758,783 | 8/1956 | Podbielniak | 494/43 |
| 3,231,185 | 1/1966 | Podbielniak | 494/43 |
| 3,254,832 | 6/1966 | Doyle | 494/43 |

*Primary Examiner*—Robert W. Jenkins
*Attorney, Agent, or Firm*—Gregor N. Neff

[57] ABSTRACT

A multi-stage rotary inertial device and method in which rotary inertial thermodynamic impedance is used in the separation of materials according to their diferences in mass. Thus, an input flow composed of substances having two different masses is separated into two output flows having preferred concentrations, respectively, according to their different masses. Rotary inertial thermodynamic pumping is used for operation of intermediate separator stages. This can be controlled from outside the rotating device by selectively supplying heat to the rotating device.

8 Claims, 5 Drawing Sheets

ROTARY INERTIAL THERMODYNAMIC MULTI-STAGE MASS-FLOW DIVIDER

RELATED APPLICATION DATA

This patent application is a continuation-in-part of my co-pending patent application, Ser. No. 07/151,472, filed Feb. 2, 1988, now abandoned; which is a continuation-in-part of Ser. No. 06/910,820, filed Sept. 23, 1986, now U.S. Pat. No. 4,722,194; which is a continuation of Ser. No. 06/748,731, filed Jun. 25, 1985, now abandoned; which is a continuation-in-part of Ser. No. 06/598,366, filed Apr. 9, 1984, now U.S. Pat. No. 4,524,587; which is a continuation-in-part of Ser. No. 06/456,709, filed Jan. 10, 1983, now U.S. Pat. No. 4,441,337; which is a division of Ser. No. 06/240,135, filed Mar. 31, 1981, now U.S. Pat. No. 4,367,639; which is a continuation of Ser. No. 06/004,606, filed Jan. 18, 1979, now abandoned; which is a division of Ser. No. 05/770,316, filed Feb. 18, 1977, now U.S. Pat. No. 4,136,530; which is a division of Ser. No. 05/569,478, filed Apr. 18, 1975, now U.S. Pat. No. 4,010,018; which is a continuation of Ser. No. 05/078,552, filed Oct. 6, 1970, now abandoned; which is a continuation-in-part of Ser. No. 04/864,112, filed Oct. 6, 1969, now U.S. Pat. No. 3,808,828; which is a continuation-in-part of Ser. No. 04/608,323, filed Jan. 10, 1967, now U.S. Pat. No. 3,470,704, issued Oct. 7, 1969. My above-cited U.S. Patents are hereby incorporated herein by reference.

SUMMARY

In the previous above-cited patents, I have shown methods and apparatus with which the flows, temperatures, pressures, chemical compositions, and various other physical properties of working fluids can be controlled. In this, I have set forth and exploited relationships which I have called 'rotary inertial thermodynamic impedance'. This is set forth in more detail in my U.S. Pat. No. 4,010,018. In this present application, I show how rotary inertial thermodynamic impedance can be used in the separation of materials according to their difference in mass, resulting in dividing an input flow composed of objects having two different masses into two output flows having preferred concentrations respectively of the two objects according to their different masses. As one example out of many, these two could be molecules of isotopes of some atomic type being sorted, such as uranium hexaflouride being sorted to concentrate isotope U-235 relative to isotope U-238.

Using rotary inertial thermodynamics ('RIT'), interstage pumping needed for operation of intermediate separator stages arises from thermal effects in the rotating system, which can be controlled from outside the rotating device. Use of RIT means for radial transport of working substances advantageously provides further ability to nest portions of the system. In a preferred multistage embodiment, many interstage flows are driven by RIT effects using heat supplied as light from digitally controlled, stationary light sources, which are synchronized with the rotating device. It is noted that the ability to use a large number of separation stages within a single rotating device may significantly change the economics of scale for isotope separation. Another consequence of note is that, with operation of sufficiently many stages in a single device, weapons grade U-235 would be obtainable from naturally occurring uranium in a single pass through a single device.

The foregoing and other objects and advantages will be set forth in or apparent from the following description and drawings. Because many important features of rotary inertial thermodymanics are taught in my above-incorporated U.S. Pat. No. 4,010,018, figures herein continue the extension of numbering which started therein and which has variously been extended in subsequent patents of mine in RIT.

BRIEF DESCRIPTION OF THE DRAWINGS

In FIG. 87, device 3100 rotates rapidly about axis of rotation 1 in the direction indicated by arrow 12. Device 3100 comprises a large number of separator stages 3101, of which only a few are indicated. These separator stages are grouped to form nested shells, 3102 and 3103, of which, for simplicity, only two are shown here.

In FIG. 90 is depicted one such separator stage 3101, depicted as being at a distance from axis of rotation 1, not to scale. Each typical intermediate separator stage is equipped at one end with gas conduit means 3105 and at the other end with a gas conduit means 3104. Consider the separation of a substance in which the incoming gas is composed of otherwise identical molecules which have one of two different molecular weights, such as uranium hexaflouride made using a mixture of U-235 and U-238. Gas on which separation work is to be done enters at inlet 3118, moves in the direction generally indicated by arrow 3119, passes through mixing plenum 3106 which contains heat exchange means 3127, passes through tangentially oriented slit 3107, passes through optional thermally conductive flow-spreader 3141, and moves substantially paraxially in the direction generally indicated by arrow 3108. While the gas is moving through separator 3101, it is acted on by the inertial acceleration in the rotating system. This causes a change in the relative concentration of the different gas components, according to their relative masses. By inertial effects in the rotating system, each of these components of the gas tends to move toward having a distribution in which its absolute pressure is greatest against the radially outermost inner wall 3110 of separator stage 3101, and is least against the innermost wall 3109 of separator stage 3101. In doing this, the molecules diffuse to have a difference in relative concentration, with the gas component composed of less massive molecules having less absolute pressure difference between innermost wall 3109 and outermost wall 3110 than does the gas component composed of the more massive molecules. Thus, the lighter gas molecules have a slightly greater concentration toward radially innermost inner surface 3109 and the heavier gas molecules have a slightly greater concentration toward radially outermost inner surface 3110, in both cases in comparison to the concentration each respectively had upon entering separator 3101 through slit 3107. The gas is then divided into two flows, the flow which has been slightly enriched in lighter molecules flows in the direction generally indicated by arrow 3111, passes through exit slit 3113 in gas conduit means 3104, which slit 3113 is located substantially adjacent to innermost inner surface 3109, moves radially outward in the direction generally indicated by arrow 3120, passing through heat exchange means 3114, leaves conduit means 3104 through outlet 3115, and continues into conduit means 3116. The gas which has been slightly depleted of lighter molecular component proceeds in the direction generally indicated by arrow 3112, passing through exit slit 3117 into gas means 3104, moves radially inward in the direction generally indicated by arrow 3124, passing through heat exchange means 3125, and leaves gas conduit means 3104 through port 3231 as depicted in FIG. 88.

FIG. 88 is a fragmentary view of the left end of the structure shown in FIG. 90. Adjacent separator stages are connected by means of conduit tubes shaped as U tubes. For example, U tube 3203 carries heavier output gas from separator 3101 to be input to separator 3101'', and U tube 3126 carries lighter output gas from separator 3101 to be input to separator 3101'. By supplying heat through thermal impedance Z3201, generally schematically depicted in FIG. 87 as comprising synchronized power supply 3213, electrically conductive wires 3212, light emitting diode 3211, lens 3210, and light beam generally designated 3209, the radially inwardly directed flow of gas in U tube 3203 can be caused to have less density on side 3213 than it would have at the corresponding radial distance from axis 1 in side 3214. Thus, pumping can be produced, causing the gas to move toward separator 3101''. Similarly, heat supplied through thermal impedance generally designated Z3202 can be used to provide pumping of gas from separator 3101 to separator 3101'. Note that thermal impedance Z3202 can, for example, be accomplished using the same apparatus as Z3201 by delivering energy when U tube 3126 is in the appropriate range of position as the rotation of 3100 carries it by. By providing flow resistance means 3138 for each of these flows, for example as may be provided by narrowness in the various U-tubes or by other means as set forth in my U.S. Pat. No. 4,010,018 herinabove incorporated herein by reference, the pumping can be made to dominate the interstage motion of working fluid, thus providing interstage flow control. The numerous interstage flows are thus subject to the exquisitely delicate external control provided by detailed synchronous control of the optically-coupled thermal input to each separate interstage pumping U-tube as they go by one or more stationary light-emitting means. Thus, separators as little as a few millimeters wide could advantageously be connected to form a multiple-stage separation system within a single rotating device, in this case, for causing lower molecular weight component to progress within the rotating device among successive stages generally in the direction indicated by arrow 3140, with the subtantially paraxial flow in successive stages being in alternating orientation; that is, the input ends of 3101' and 3101'' are at the same end of the device as the output end of 3101, and so on.

Figure 87:
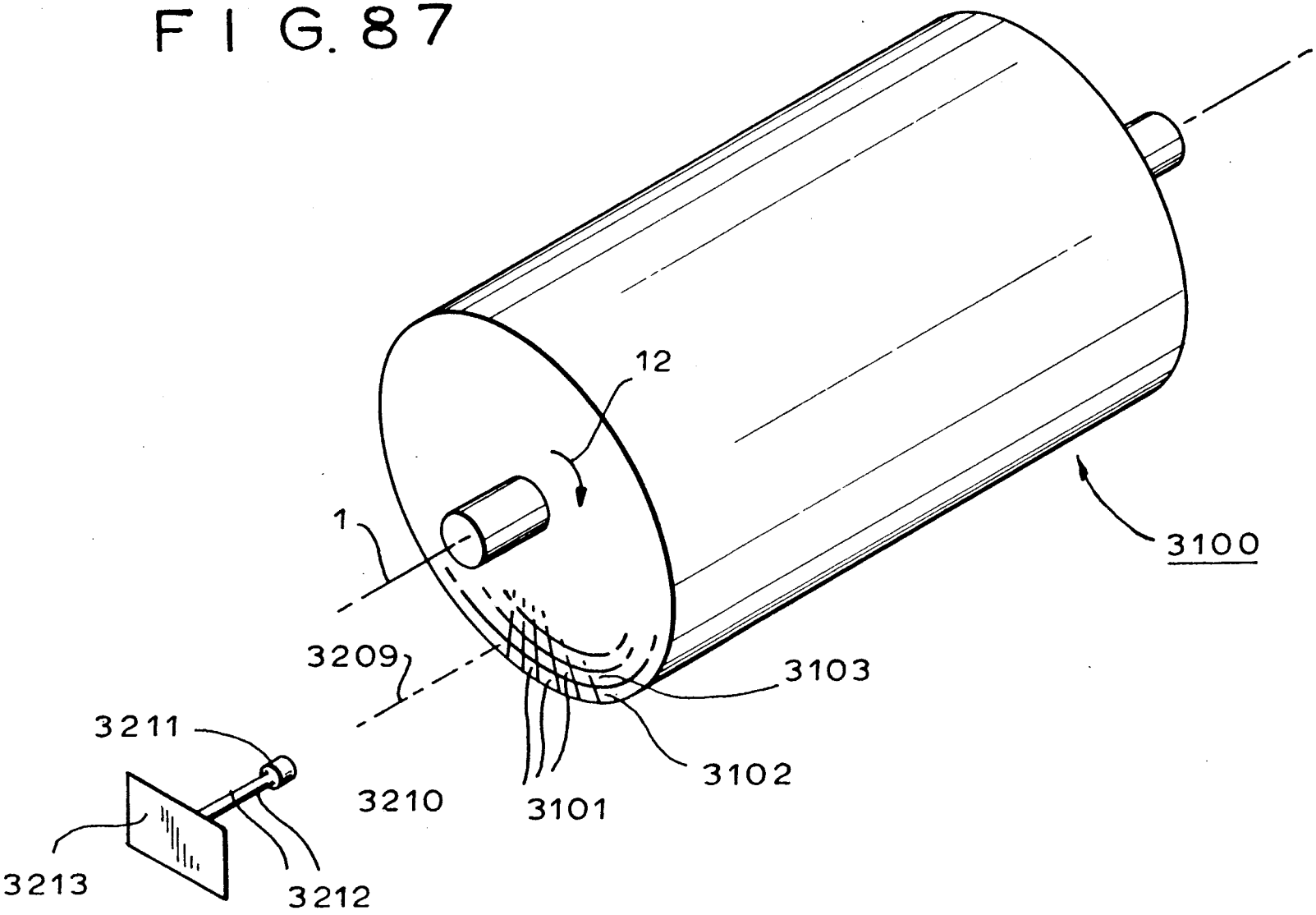
FIG. 87 is a schematic perspective view of a separator device constructed in accordance with the present invention, and illustrating a few adjacent separator stages.
Figure 88:
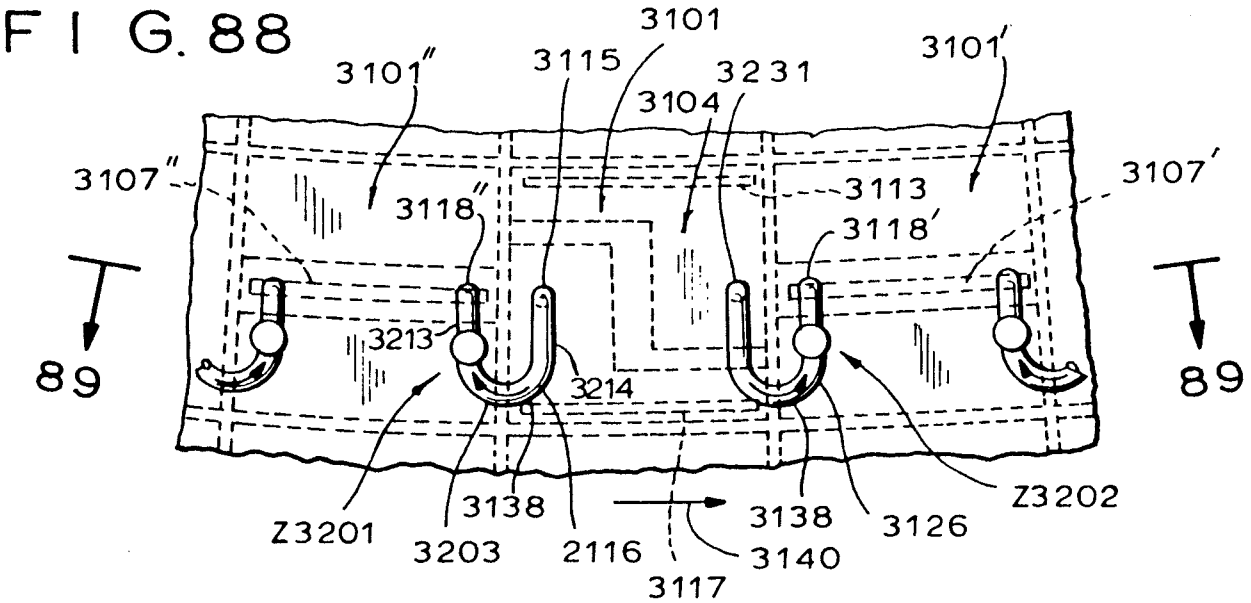
FIG. 88 is a fragmentary left end elevation view of the structure shown in FIG. 90, and depicts rotary inertial thermodynamic interstage gas pumping means.
Figure 92:
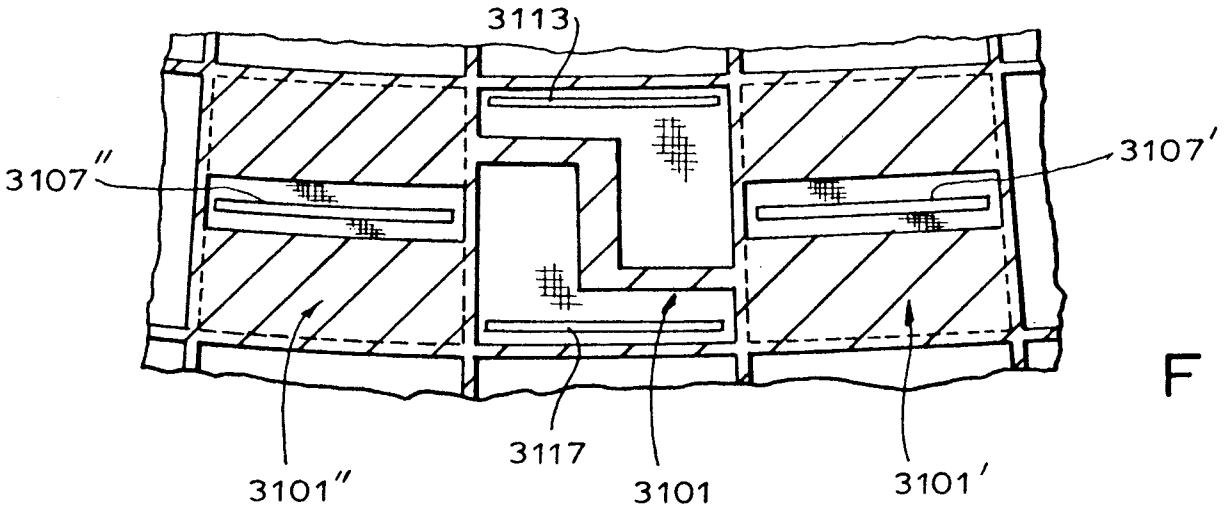
FIGS. 92, 93 and 94 are cross-sectional view taken along lines 92—92; 93—93; and 94—94, respectively of FIG. 89.
Figure 89:
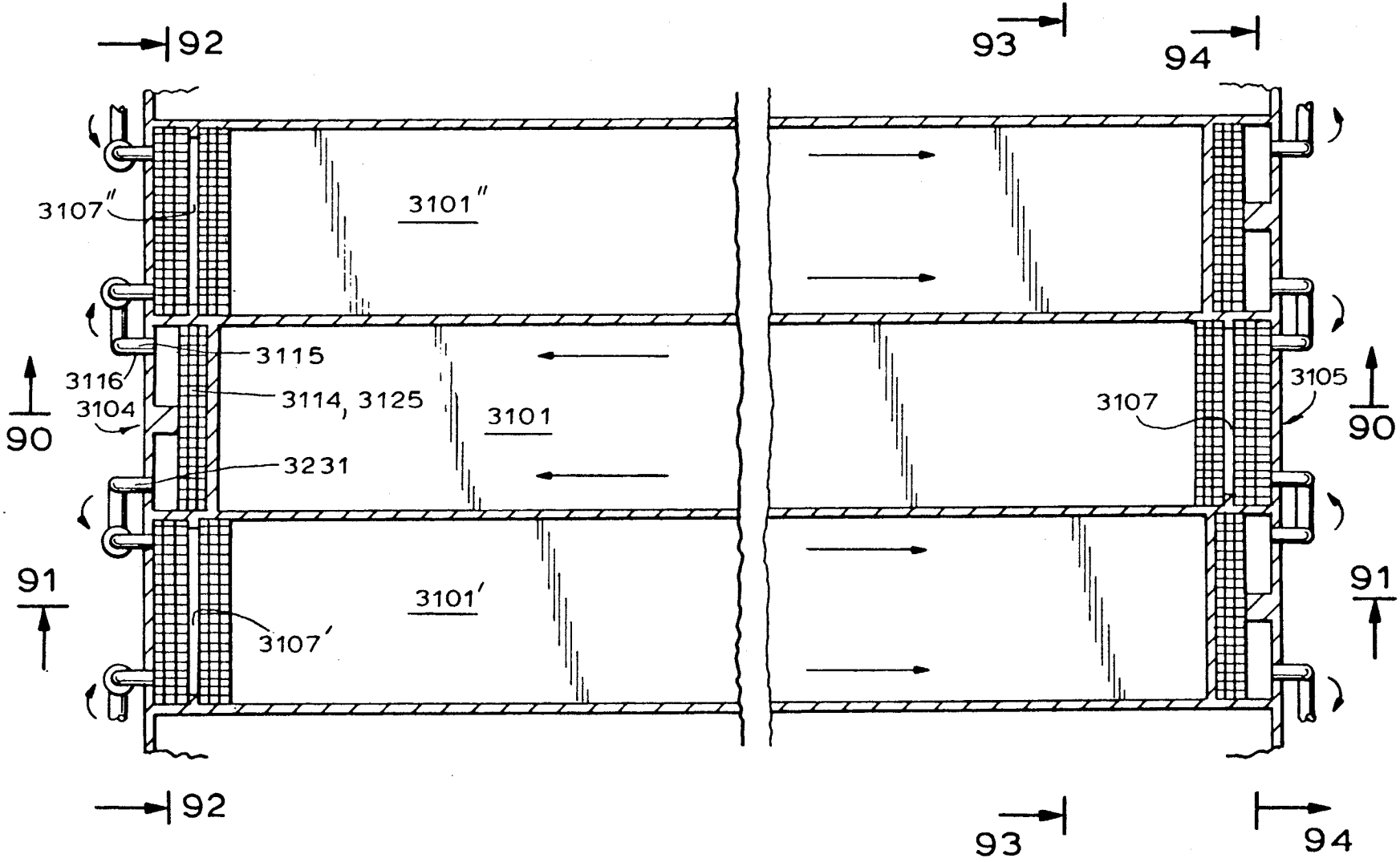
FIG. 89 is a cross-sectional view taken along line 89—89 of FIG. 88.
Figure 90:
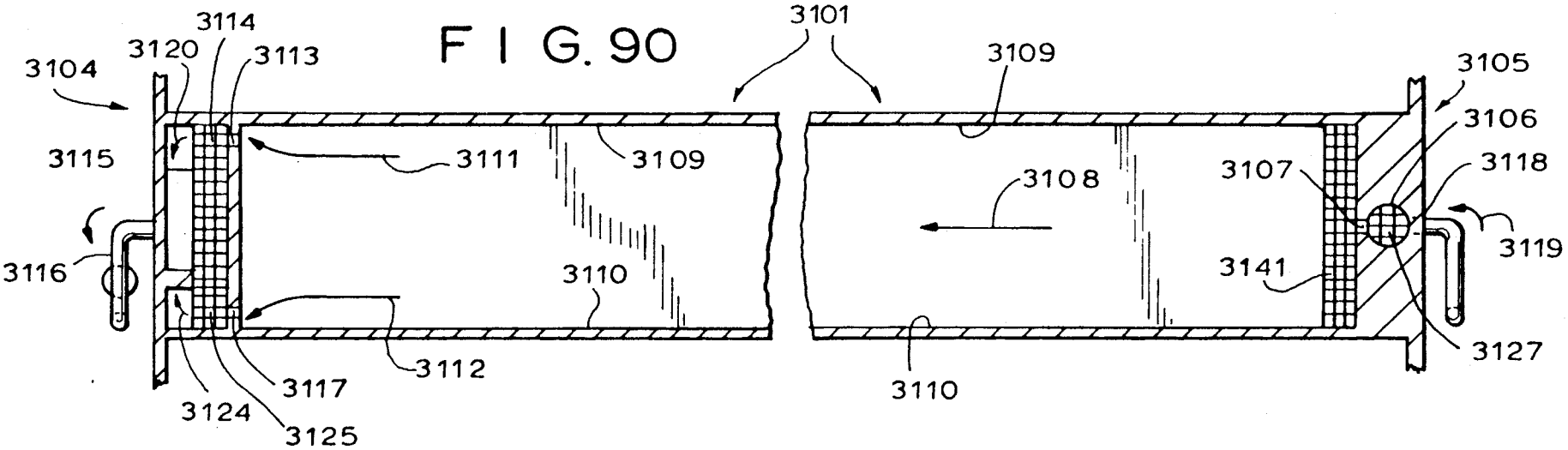
FIG. 90 is an enlarged cross-sectional view, taken along line 90—90 of FIG. 89, of one of the separators.
Figure 91:
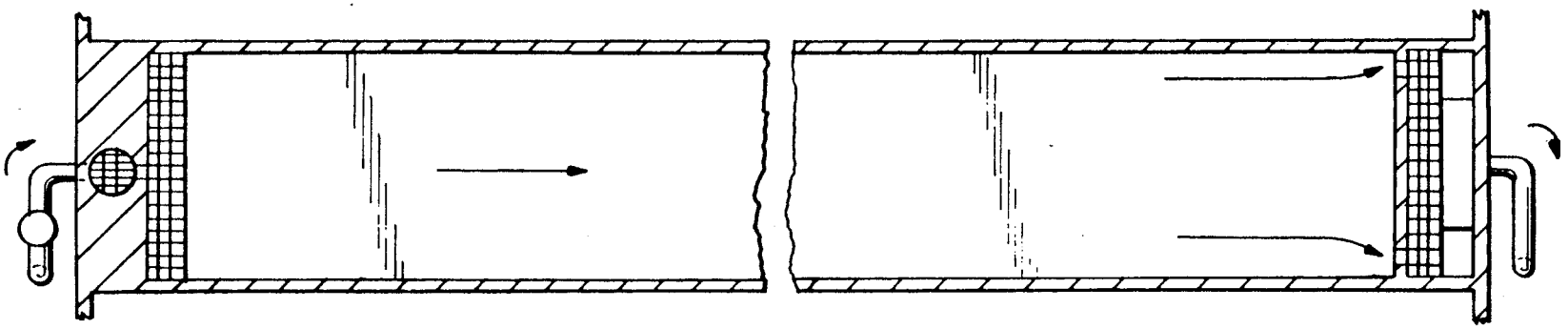
FIG. 91 is a cross-sectional view taken along line 91—91 of FIG. 89.
Figure 93:
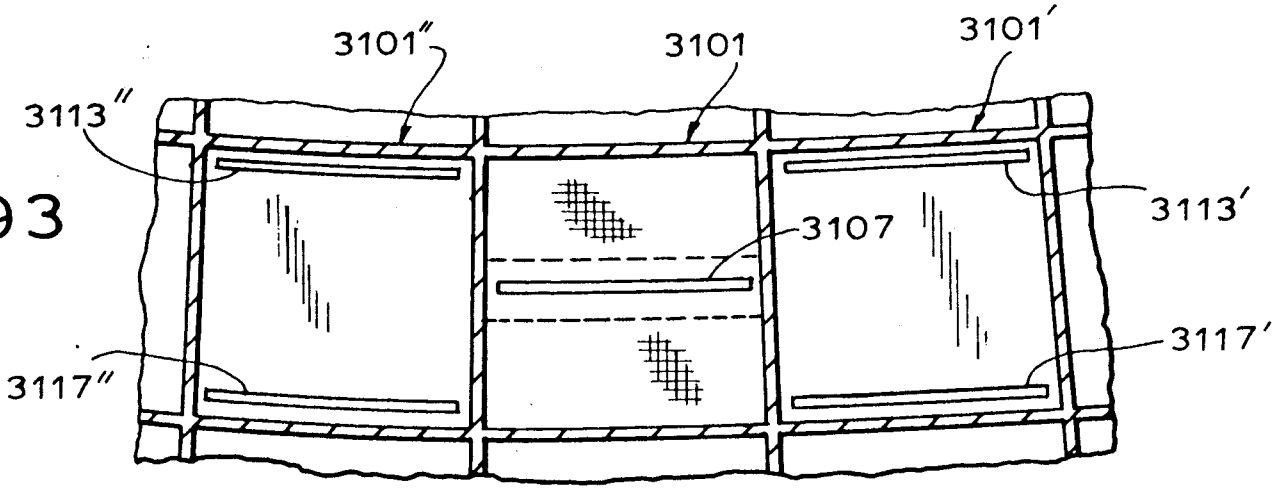
Figure 94:
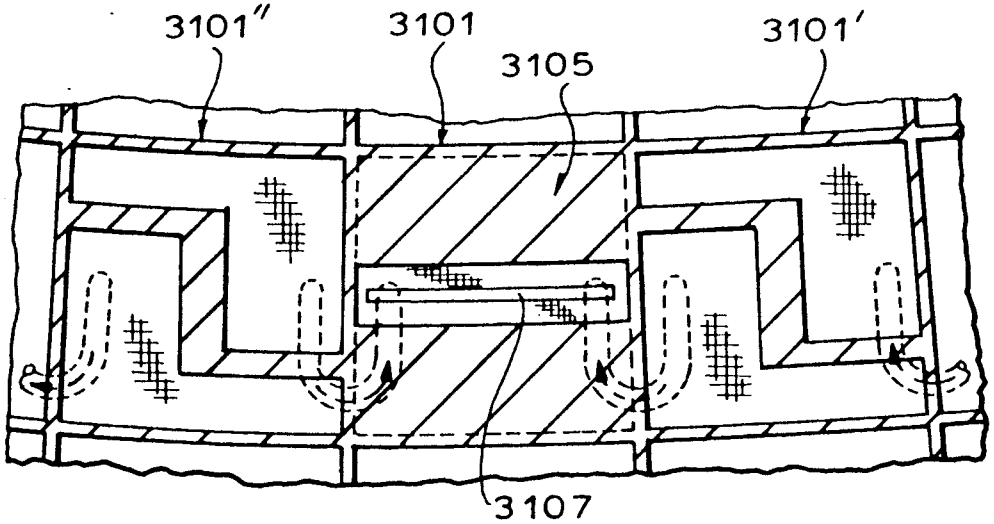

It should be understood that the example given here may be altered in accordance with rotary inertial thermodynamics, for example, as by making use of various of the many configurations and methods set forth elsewhere in my patents hereinabove incorporated herein by reference, without departing from the scope of the invention.

I claim:

1. Rotary inertial thermodynamic apparatus for separating molecules according to their relative masses, comprising a plurality of separation means coupled with respect to the flow of fluid by a rotary inertial thermodynamic pump means.

2. A rotary inertial thermodynamic apparatus as in claim 1, in which said pump means comprises at least one conduit means connecting the flow outlet of at least one separation means to the flow inlet of at least one other separation means, said conduit means comprising an inlet, a first conduit portion extending to a maximum radial distance further from the axis of rotation than the radial distance at which is said inlet, a second conduit portion extending from said maximum radial distance to an outlet at a distance from said axis of rotation less than said maximum radial distance, and a third conduit portion joining said first and said second conduit portions at said maximum distance.

3. An apparatus as in claim 2, in which the path of flow through said pump means passes through a flow-resistance means.

4. An apparatus as in claim 2, in which heat is coupled into a selected portion of said pump means.

5. An apparatus as in claim 4, in which said coupling of heat is accomplished by illuminating said selected portion of said conduit.

6. A rotary inertial thermodynamic method for separating molecules according to their relative masses, comprising rotating a plurality of separation means, and rotary inertial thermodynamically pumping fluid among said plurality of separation means.

7. A method as in claim 6, wherein said pumping is accomplished by heating a portion of a conduit joining at least two said separation means.

8. A method as in claim 7, in which said heating is accomplished by illuminating said portion.

* * * * *